US005458029A

United States Patent [19]

Walsky

[11] Patent Number: 5,458,029

[45] Date of Patent: Oct. 17, 1995

[54] TOOL FOR REMOVING THE BASE OF A BROKEN LIGHT BULB FROM A SOCKET

[76] Inventor: Robert S. Walsky, 22 Angela Ct., Woodcliff Lake, N.J. 07675

[21] Appl. No.: 304,768

[22] Filed: Sep. 12, 1994

Related U.S. Application Data

[63] Continuation-in-part of Ser. No. 830, Oct. 26, 1992, Pat. No. Des. 350,465.

[51] Int. Cl.[6] ..... B25B 7/12

[52] U.S. Cl. ..... 81/302; 81/424.5

[58] Field of Search ..... 81/302, 424.5

[56] References Cited

U.S. PATENT DOCUMENTS

| | | | |
|---|---|---|---|
| D. 183,706 | 10/1958 | Simmons . | |
| D. 298,297 | 11/1988 | Maltby . | |
| 1,085,752 | 11/1918 | Loisselle et al. . | |
| 1,319,028 | 10/1919 | Grinnell . | |
| 2,117,017 | 6/1938 | Chadsey . | |
| 2,382,170 | 8/1945 | Phillips . | |
| 2,429,884 | 10/1947 | Leigh . | |
| 2,482,501 | 9/1949 | Oravetz . | |
| 2,497,633 | 2/1950 | Shapiro et al. . | |
| 2,516,650 | 7/1950 | Shapiro et al. . | |
| 2,595,989 | 5/1952 | Smeltz . | |
| 2,721,492 | 10/1955 | Prevost . | |
| 2,787,492 | 4/1957 | Gisser et al. . | |
| 3,284,123 | 11/1966 | Adams . | |
| 3,602,971 | 9/1971 | Halstead . | |
| 3,740,814 | 6/1973 | Marshall . | |
| 3,797,055 | 3/1974 | Greene . | |
| 3,823,462 | 7/1974 | Kanda . | |
| 3,916,907 | 11/1975 | Peterson . | |
| 4,018,110 | 4/1977 | Spriggs . | |
| 4,485,701 | 12/1984 | Hough . | |
| 4,499,799 | 2/1985 | Bordages . | |
| 4,791,925 | 12/1988 | Mitterer | 87/302 X |
| 4,907,477 | 3/1990 | Farber . | |
| 4,934,171 | 6/1990 | Konetzke, Jr. . | |
| 5,103,695 | 4/1992 | Dolle . | |
| 5,371,658 | 12/1994 | Christie | 87/302 X |

OTHER PUBLICATIONS

Advertising brochure entitled "Model CTB Constant Torque Hinge", Reell Precision Manufacturing Corporation, 1259 Wolters Blvd., St. Paul, Minn., 55110 U.S.A.

*Primary Examiner*—James G. Smith

*Attorney, Agent, or Firm*—Gottlieb, Rackman & Reisman

[57] ABSTRACT

A tool for removing the base of a broken light bulb from the socket is disclosed. The tool is comprised of at least one curved tip adapted to engage the inside surface of the broken light bulb base and handles attached to the curved tip. When the handles are compressed, the tip expands to firmly fit into the broken light bulb base. Rotation of the tool causes the base to become loosened and then removed from the socket.

5 Claims, 2 Drawing Sheets

TOOL FOR REMOVING THE BASE OF A BROKEN LIGHT BULB FROM A SOCKET

This is a continuation-in-part of Ser. No. 000,830 filed on Oct. 26, 1992, now U.S. Pat. No. 350,465.

BACKGROUND OF THE INVENTION

A. Field of the Invention

This invention relates to an apparatus for removing the base of a broken light bulb from a screw-type jacket or socket.

It is quite common for an incandescent screw-type light bulb to break while still remaining in the socket or jacket. This can be caused by use of an improper wattage bulb, one too strong for the fixture in which it was placed, or by the use of the incorrect type of bulb, such as use of a variable wattage bulb in a one-wattage fixture. Such improper usage usually results in the bursting of the fragile glass bulb. Screw-type incandescent bulbs are fastened to and removed from the socket by rotating the glass bulb portion. Such rotation cannot occur when the glass bulb has shattered. Therefore, there is a need for a device to enable safe removal of the base of the broken light bulb.

B. Description of The Prior Art

Methods for removal of a broken light bulb base include physically clearing away the remnants of the broken glass and attempting to rotate the base with one's fingers or by using a device not intended for that purpose, such as a pliers. Prior art devices for this purpose have been fashioned, as described in Greene, U.S. Pat. No. 3,797,055 issued Mar. 19, 1974, Hough, U.S. Pat. No. 4,485,701 issued Dec. 4, 1984, and Farber, U.S. Pat. No. 4,907,477 issued Mar. 13, 1990. Greene and Hough each disclose light bulb base removal tools which have tips with flanges for inserting into the light bulb base. Farber discloses a light bulb base removal apparatus having a tip with serrated edges. Each of these prior art tools share the same disadvantage—the roughness of the flanges and the serrated edges can cause the broken base to deteriorate further, creating metal fragments and causing difficulty in base removal. Also, since each rough flange has only one point of contact with the base, the tool has the tendency to slip off the base.

The light bulb base removal tool of my invention deals with this problem by having a tip which is smooth and curved, following the shape of the base to be removed.

SUMMARY OF THE INVENTION

The base removal tool of my invention comprises a handle having an upper and lower portion, connected by a pivot. Each portion of the handle has two curved members. The two lower members, or handgrip, are curved inward, such that the operator's hand has an easy grip. The upper handle portion terminates in a curved tip which is inserted into the base of the broken light bulb. When the two curved members of the handgrip are squeezed, the curved tip expands to contact the inner walls of the light bulb base. The base removal tool is then rotated, to unscrew the broken light bulb base from the socket.

DESCRIPTION OF THE PREFERRED EMBODIMENT

Figure 1:
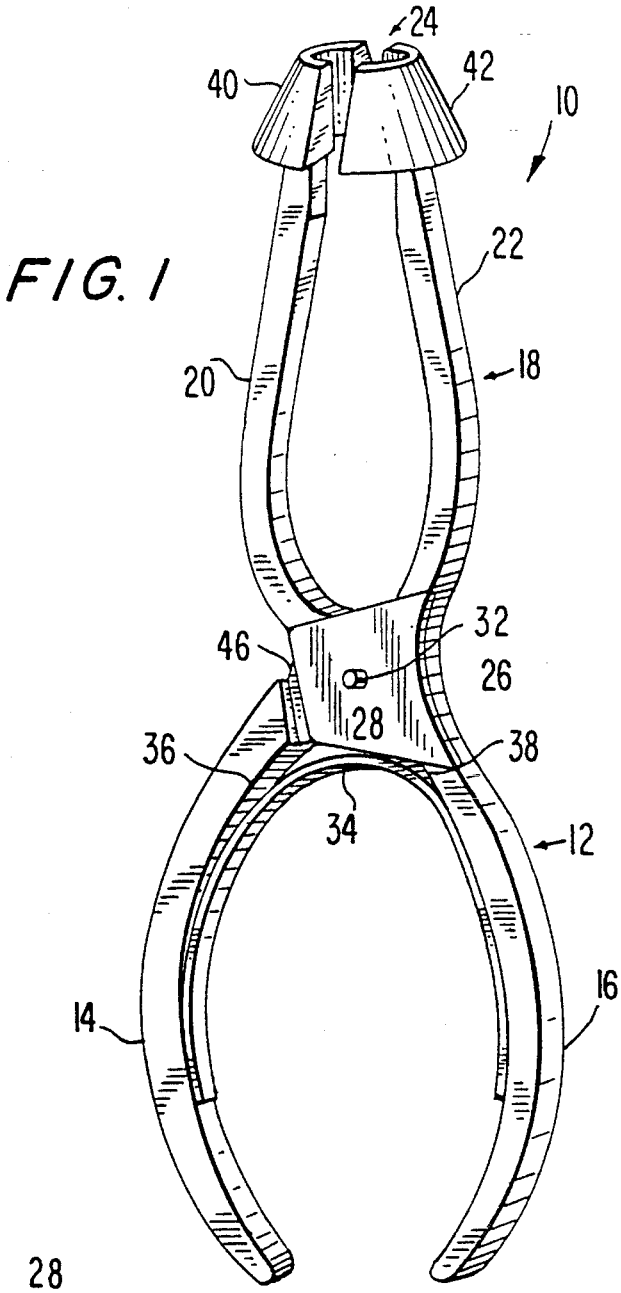
FIG. 1 is a perspective view of the tool for removing the base of a broken light bulb from a socket.
Figure 2:
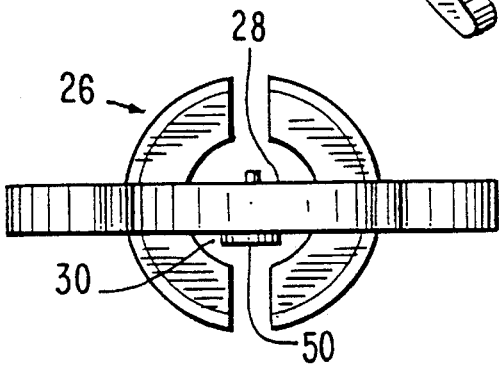
FIG. 2 is a bottom plan view of the tool of FIG. 1.
Figure 3:
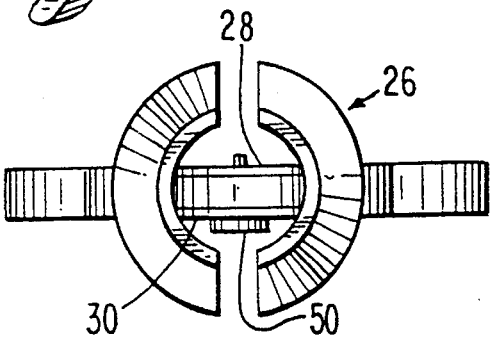
FIG. 3 is a top plan view of the tool of FIG. 1.
Figure 4:
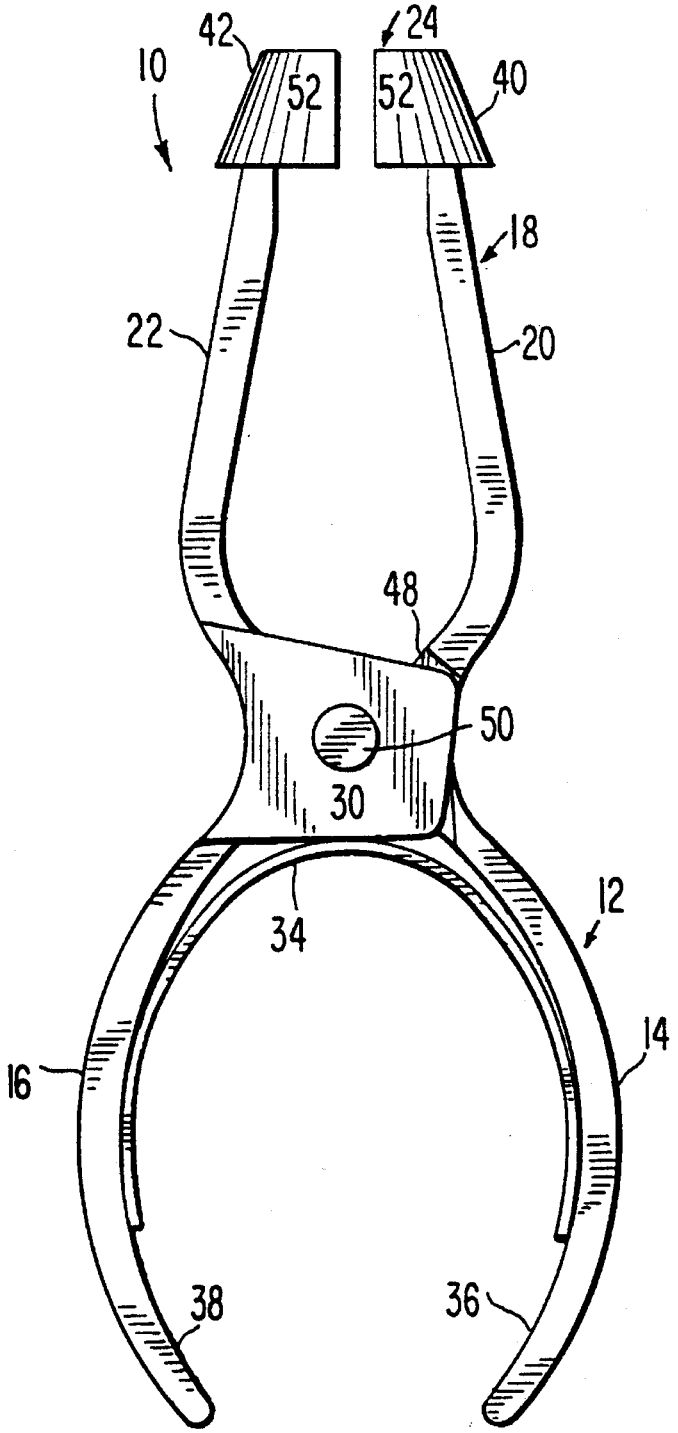
FIG. 4 is a front plan view of the tool of FIG. 7.

Referring to the drawings by numerals of reference, FIGS. 1 and 4 show light bulb base removing tool 10, comprised of a handgrip 12 with two prongs 14 and 16, and a pincer 18 with two prongs 20 and 22 which terminate in curved tip 24. Pivot joint 26 is located between hand grip 12 and pincer 18. Pivot joint 26 surrounds pivot base 44. Pivot joint 26 is comprised of front face 28, seen on FIG. 1, and rear face 30, seen on FIG. 4. Pivot pin 32 extends through pivot joint 26.

Removal tool 10 is constructed with curved spring 34, which is disposed within handgrip 12, following inner surfaces 36 and 38 of prongs 14 and 16, respectively, and curving underneath pivot joint 26.

Figure 5:
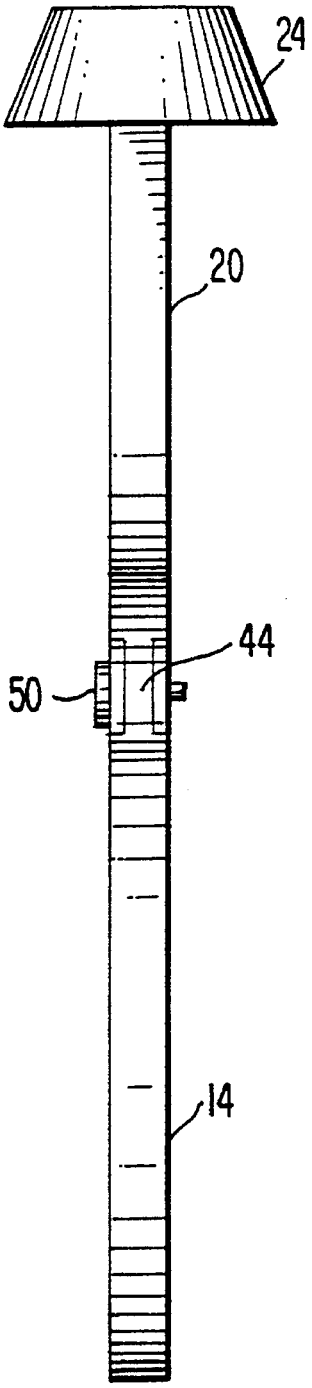
FIG. 5 is a right side view of the tool of FIG. 1.

Removal tool 10 is preferably manufactured in two parts. Handgrip prong 16, pivot joint 26, pincer prong 22, and curved tip member 42 are formed into one piece. Handgrip prong 14, pivot base 44, pincer prong 20, and curved tip member 40 are formed into a second piece. Both pivot joint 26 and pivot base 44 are created with a hole through which pivot pin 32 is placed, as seen in FIG. 5. Removal tool 10 is made by placing the first piece, containing pivot joint 26, over the second piece, containing pivot base 44, such that the holes line up and pivot pin 32 is inserted therein. Faces 28 and 30 of pivot joint 26 do not completely cover front face 46 and rear face 48 of pivot base 44, as is seen on FIGS. 1 and 4. Head 50 of pivot pin 32 is permanently affixed to joint face 30, such as by gluing. Once the two pieces are attached to each other, curved spring 34 is annexed to inner surfaces 36 and 38 of handgrip prongs 14 and 16. Curved spring 34 may be initially formed by one or more curved members.

Curved tip 24 is adapted to fit into the base of a light bulb remaining in the socket (not shown). Curved tip 24 is comprised of two curved members 40 and 42, affixed respectively to prongs 20 and 22. Each curved member 40 and 42 has a conical shape, designed to contact most of the inner wall surface of the broken base, which facilitates insertion into and removal of the broken light bulb base.

When prongs 14 and 16 of handgrip 12 are squeezed or compressed, prongs 20 and 22 of pincer 18 expand and curved tip 24 (previously placed inside the broken light bulb base) also expands, fitting tightly into the base. Handgrip 12 is then rotated and curved tip 24 acts to unscrew the base from the socket. When prongs 14 and 16 of handgrip 12 are pulled apart, curved tips 40 and 42 meet and tool 10 can be removed from the broken base. The surface 52 of curved tip 24 is smooth, thus preventing additional damage to the broken light bulb base. Use of tools having serrated edges or flanges, such as those found in the prior art, could cause damage to the base during rotation by scraping off metal from the base when rotated. Moreover, tools with serrated flanges have only a limited area of contact with the broken base and may slip out. The base removing tool 10 of my invention avoids these problems and improves upon the state of the art since surface 52 of curved tip 24 is smooth and contacts a large portion of the broken base, as seen in FIGS. 1, 4 and 5. The tight fit of curved tip 24 into the base, by virtue of the base-conforming shape of tip 24 and the expansion of tip 24 in the base, permits the user to apply the proper amount of rotational force to unscrew the base.

Prongs 14 and 16 of handgrip 12 have been formed in a curved manner, as depicted in FIGS. 1 and 4, to enable the user to easily manipulate tool 10. It is more difficult for human hands to manipulate tools with straight handgrips, as are found on typical pliers. Curved spring 34 aids in the compression and release operation of base removal tool 10. Handgrip 12 can also be constructed with a locking mechanism (not shown), comprised of a first bar extending horizontally from surface 38 of prong 16 and a second bar extending horizontally from surface 36 of handgrip 14. Each bar is made with serrated edges on one face thereof, such that the serrated edges face each other. When handgrip 12 is manipulated, the serrated edges meet and interlock together, preventing further manipulation of handgrip 12 and serving to stabilize tool 10 when removing the broken light bulb base.

Although the invention has been described with reference to particular embodiments, it is to be understood that these embodiments are merely illustrative of the applications of the principles of the invention. Numerous modifications may be made therein and other arrangements may be devised without departing from the spirit and scope of the invention.

I claim:

1. A tool for removing a broken light bulb base having an inner wall surface from a socket comprising:

a first extending handle and a second extending handle, each having a width and a length, and a first end and a second end, said handles pivotally joined intermediate their ends;

a light bulb base engaging tip integral with and extending from and above each of said first ends of said joined handles, each said tip having a length transverse to the length of its respective handle and a width;

wherein each of said tips has a arcuate outer engaging surface extending in a direction substantially transverse to the length of each of said extending handles and in substantially diametrically opposed non-facing relationship from each other;

wherein each of said tips is integrally connected to the first end of its respective handle, said length of each said tip being being substantially greater than the width of said connected handle such that said tip extends past said connected handle on either side thereof.

2. The tool of claim 1, wherein each said outer engaging surface defines an arcuate length and is tapered such that the arcuate length of the surface increases substantially continuously in a direction towards said first end of said handle.

3. The tool of claim 1, wherein each of said handles defines a grip element located below where said handles are joined, and an arm located above where said handles are joined.

4. The tool of claim 3, further including spring means fixed between said grip element of said handles for biasing said handles to a first closed condition.

5. The tool of claim 4, wherein said spring means comprises a leaf spring having one end secured to one said handle grip element and a second end secured to the other said handle grip element.

* * * * *